United States Patent [19]

Radek et al.

[11] Patent Number: 4,624,455

[45] Date of Patent: Nov. 25, 1986

[54] SHEET HANDLING MACHINE

[75] Inventors: John R. Radek, Hinsdale; Thaddeus S. Flowers, Chicago, both of Ill.

[73] Assignee: Ready Metal Manufacturing Company, Chicago, Ill.

[21] Appl. No.: 622,866

[22] Filed: Jun. 20, 1984

Related U.S. Application Data

[63] Continuation-in-part of Ser. No. 448,352, Dec. 9, 1982, abandoned.

[51] Int. Cl.[4] ..... B65H 29/10

[52] U.S. Cl. ..... 271/85; 271/176; 414/82

[58] Field of Search ..... 414/69, 70, 71, 76, 414/82, 786; 271/85, 84, 176

[56] References Cited

U.S. PATENT DOCUMENTS

| | | | |
|---|---|---|---|
| 2,890,675 | 6/1959 | Cheever, Jr. | 414/70 X |
| 3,670,611 | 6/1972 | Jarman | 83/81 |
| 3,729,190 | 4/1973 | Harris et al. | 414/69 X |
| 3,747,920 | 7/1973 | Linkus | 271/85 |
| 3,891,204 | 6/1975 | Mager | 414/69 X |
| 4,055,261 | 10/1977 | Schneider | 414/71 |
| 4,284,382 | 8/1981 | Silverman | 271/85 X |

FOREIGN PATENT DOCUMENTS

| | | | |
|---|---|---|---|
| 181151 | 6/1922 | United Kingdom | 271/84 |

*Primary Examiner*—Leslie J. Paperner
*Assistant Examiner*—Ken Muncy
*Attorney, Agent, or Firm*—Samuel Lebowitz

[57] ABSTRACT

A sheet handling machine or stacker, designed to stack sheets in such manner as to avoid tumbling or other movement resulting in possible scratching or other surface marring. Our invention is especially applicable to sheets having a relatively soft surface such as plastic-coated sheet metal, highly polished stainless steel or the like, synthetic plastic such as "vinyl," paper-covered stainless steel, etc. Our invention contemplates a machine comprising a receiver having a lateral opening designed to receive a portion of a sheet. In operation, the receiver is moved through a predetermined trajectory. In its first position the receiver seats a portion of a sheet as from a conveyor, aligns it with a stack of similar sheets and then discharges it from a position above a stack of such sheets, allowing it to drop by gravity onto the stack through a free air cushion between sheet and stack, whereby the sheet is prevented from tumbling or otherwise falling haphazardly. Instead, the sheet drops in a substantially straight vertical trajectory. The receiver is then returned to its first position to repeat the operation. Preferably, the motion is activated by compressed air. Our invention covers both a machine and method for handling sheets.

3 Claims, 2 Drawing Figures

SHEET HANDLING MACHINE

This application is in part a continuation of our copending application Ser. No. 448,352 filed Dec. 9, 1982 now abandoned.

Our invention relates generally to sheet stackers, being especially applicable to thin sheet material having a surface especially susceptible to scratching or other marring. More particularly, our invention has to do with devices for stacking into a pile a collection of substantially identical sheets in such manner as to avoid tumbling or other undesirable movement that might result in scratching or other surface marring.

BACKGROUND

After shearing a large sheet of metal, plastic, plastic-coated or paper-coated metal or the like as received from the fabricator, to obtain units of predetermined smaller size for further fabrication, the sheared units usually are moved from the shear onto a conveyor and thence stacked for further operations.

According to usual practice, it is customary for the individual sheared units to tumble from a conveyor onto a stack to form a disorderly pile awaiting subsequent handling.

Such procedure generally is acceptable with hard surfaced material. However, scratching is likely to occur when the thin sheet material is less immune to rough handling, as with plastic, plastic-coated sheeting, highly polished stainless, paper-coated stainless steel or the like.

A major object of our invention is to provide means and a method for handling such sheets as may be susceptible to surface marring in such manner as to avoid likelihood of tumbling or other haphazard movement that might result in surface damage.

The most pertinent prior art to our knowledge is that of record in our parent application noted hereabove.

BRIEF OUTLINE OF THE INVENTION

An object of our invention is to provide improved means and method of stacking sheet-material units, and more particularly material having a nonscratch-resistant surface, in such manner as to align such units one by one in an orderly stack.

A further object of our invention is to provide means and method of handling a unit of sheet material as to align it with a stack and then allow it to drop by gravity onto said stack through a cushion of air in a substantially straight trajectory so as to avoid tumbling, thus providing a substantially unscratched, unmarred, orderly stack ready for further fabrication.

Another object is to provide automatic apparatus for accomplishing the aforesaid objects that will be simple in construction, relatively inexpensive, adjustable, certain in operation and generally satisfactory for the desired purposes.

Other objects and advantages may suggest themselves to those skilled in the art as the description proceeds.

BRIEF DESCRIPTION OF THE DRAWINGS

Referring now to the drawings illustrating a preferred embodiment of our invention.

DETAILED DESCRIPTION

Briefly outlined, our invention comprises a sheet stacker normally disposed adjacent the discharge end of a conveyor leading from a shear. Said stacker comprises a generally channel shaped receiver designed to accept and grip a sheet unit, or at least the leading portion thereof, as discharged from the conveyor. As said unit enters said receiver, it is automatically retained therein, as by nonscratching gripping means which clamps the forward portion of the sheet within the receiver while the receiver is moved downwardly and forwardly to a position slightly above a stack of similar units, or a stacking position, upon which the last-received unit is then released from the receiver and permitted to fall through an air cushion in a substantially straight vertical trajectory onto said stack, or stacking position. The receiver is then automatically returned to its original position, there to repeat the operation.

In our preferred embodiment the actuating power is provided by means of compressed air.

Numeral 10 indicates a sheet receiver or carrier designed to accept a sheared sheet unit as discharged from a conveyor C leading from a shear (not shown). While receiver 10 may be of any suitable design, we find preferable a simple channel-shaped member of dimensions appropriate to seat at least the leading portion of a unit to be stacked. Suitable sheet gripping means such as one or more air cylinders 15 equipped with pads may be provided for retaining a sheet unit within the receiver.

Figure 2:
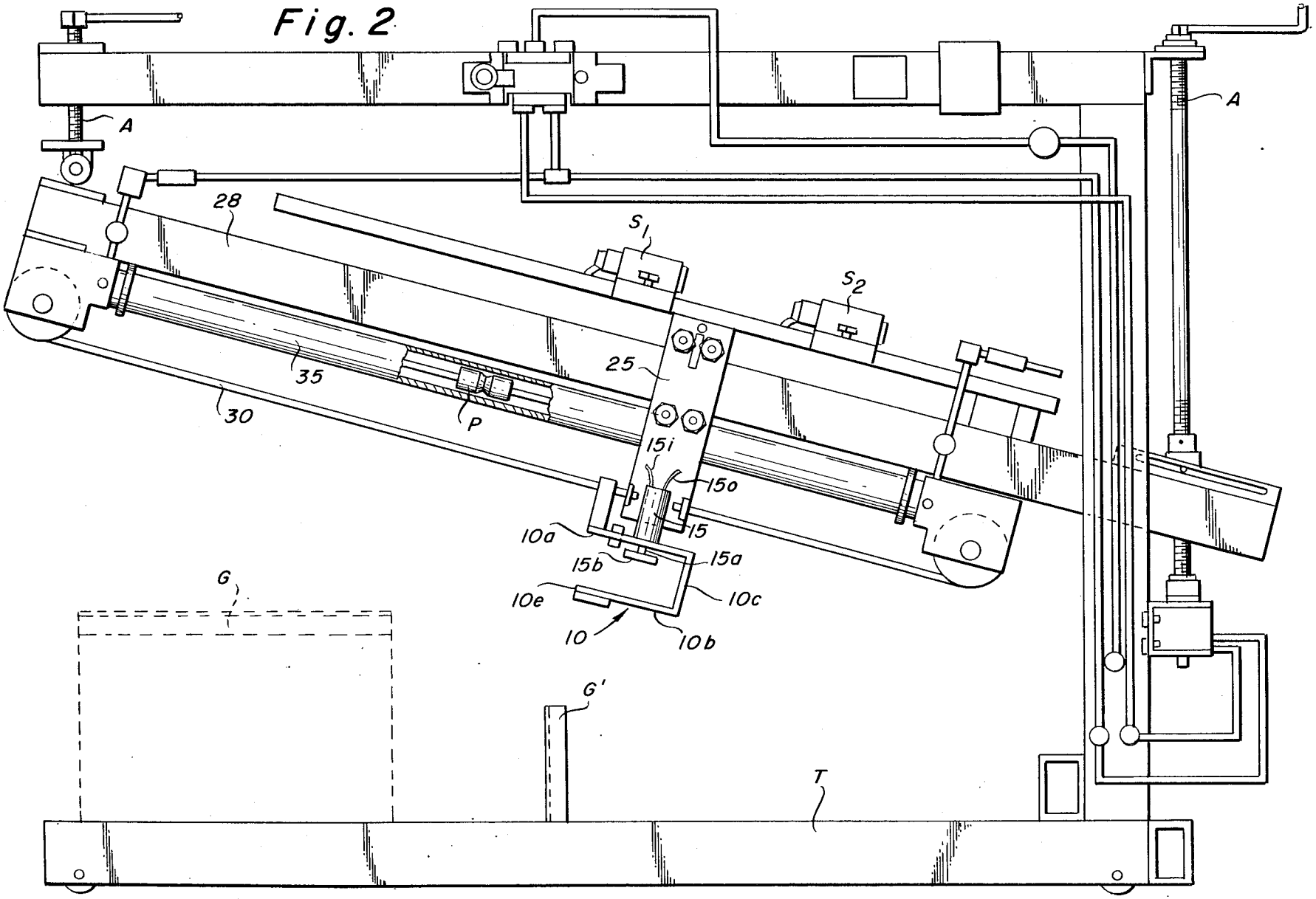
FIG. 2 is a side elevation of the same, with parts broken away for added clearness.

Receiver 10 is carried on a suitable bracket 25 slidably mounted on inclined arm 28, the elevated end of which is adjacent to the discharged end of the conveyor and the lower end of which is mounted at adjustable levels on a vertical apertured post Q. A cantilever frame extends horizontally from the top of the latter in overlying relation to arm 28 and medially of base frame T, which provides a horizontal support for the stack of sheets. Turn-screws A, A affixed to the opposite ends of arm 28 adjust the angularity thereof (FIG. 2) as well as the height of the receiver, so that the sheet units issuing from conveyor C travel freely into receiver 10 and are stopped by the closed end of the channel.

Lateral guides G (not shown in FIG. 1 in the interest of clarity) on the conveying systems leading from discharging end of the shear, as disclosed in U.S. Pat. No. 3,670,611, June 20, 1972, are provided at the front of base frame T. Vertical angle members G′ are mounted adjustably on the base frame to provide stop guides for the stack of sheets dropped by the receiver as they issue successively from the conveyor C. These may be evened up by the guides to form an orderly stack that may be picked up readily and moved to another location for further operations.

In our preferred embodiment, motion is imparted to the receiver by means of a device known on the market as a cable cylinder actuated by compressed air derived from a compressor (not shown). In practice, there is usually employed what is known "house air," i.e., compressed air conveyed to the apparatus from a remote compressor.

Cable cylinder 35 is not in itself a feature of our invention except as an element thereof. Such a device suitable for our purposes is obtainable on the market under the name or trademark "Tel-O-Matic," hence, detailed description thereof should not be required except to say that it comprises a tube within which reciprocates a piston P actuating a cable 30 in opposite directions as compressed air is applied to either side of the piston. Such a device is disclosed in U.S. Pat. No. 4,057,257 dated Nov. 8, 1977.

Channel-shaped receiver 10 is formed of upper and lower walls 10*a* and 10*b* which are bridged by web 10*c* opposite the opening through which the sheet unit enters the channel from the conveyor, until the front edge of said unit strikes web 10*c*. Air cylinders 15 are mounted on the upper wall 10*a* of channel 10 adjacent the opposite ends thereof and are provided with inlet tubes 15*i* and outlet tubes 15*o*, extending from the compressed air system mentioned hereabove. The air cylinders project and retract piston rod 15*a* when compressed air is fed to an withdrawn therefrom, respectively. Each rod is fitted at its free end with a pad 15*b* of nonscratching material which serves to engage the upper surface of a sheet when the rod is projected downwardly to clamp the front portion of the sheet against the bottom wall 10*b* of the channel.

Figure 1:
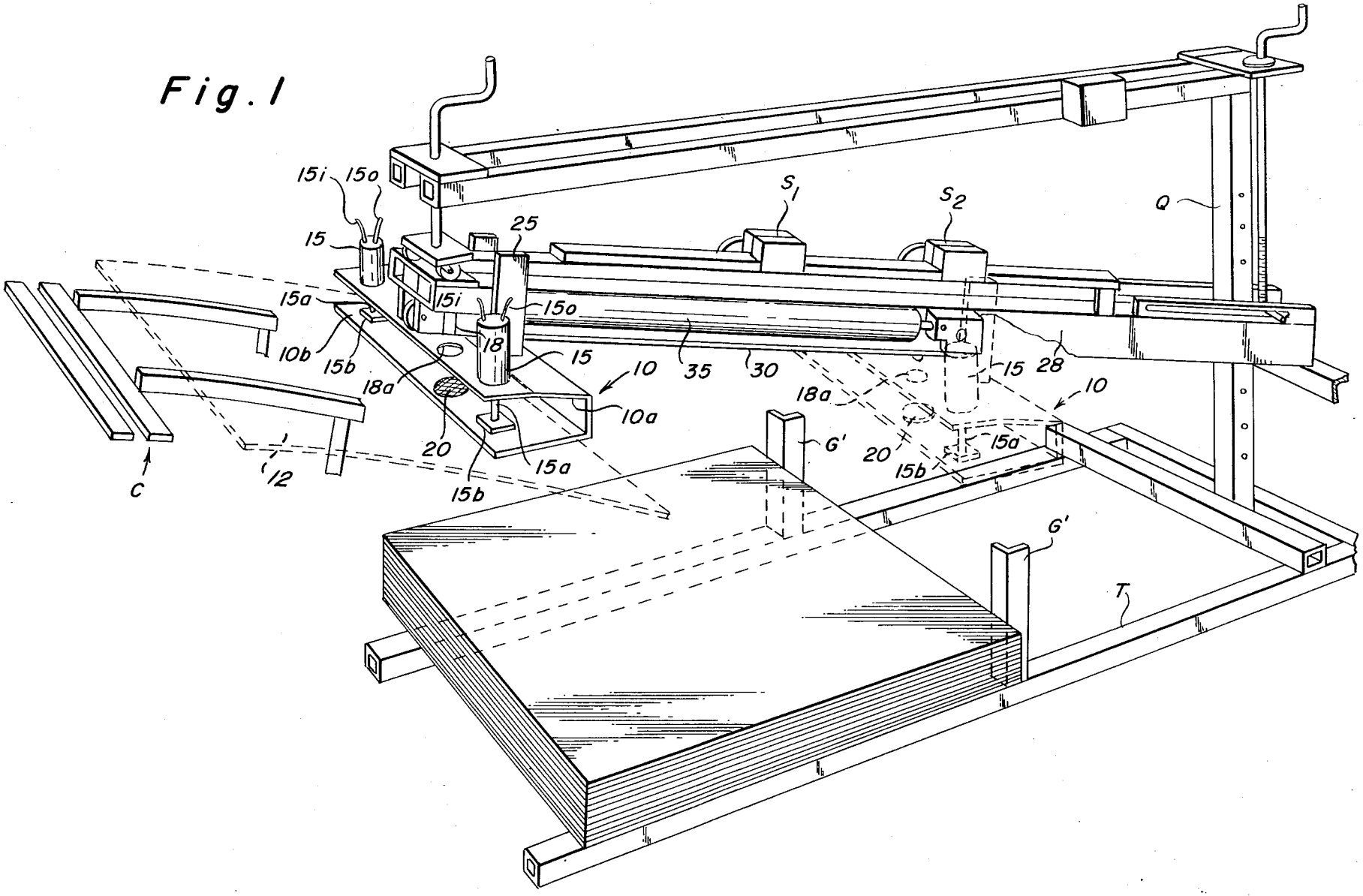
FIG. 1 is a schematic perspective view of a machine embodying our invention and designed to perform our method.

The clamping action is initiated by photo-electric means 18 mounted on the front end of arm 28, along which receiver 10 is adapted to move downwardly and forwardly from its position shown in solid lines in FIG. 1 to that shown in dotted lines. In that position a source of light or other radiant energy projects through hole 18*a* in top wall 10*a* of the channel against a photoelectric cell 20 to maintain the system in the position shown in FIG. 1.

When sheet 12, issuing from conveyor C, interrupts the beam of radiant energy from source 18 to cell 20 by entry into channel 10, an electrical circuit is completed for actuating the valves of the pneumatic system, to project the pads 15*b* at the ends of rods 15*a* against the sheet to clamp the latter tightly. At the same time, the pneumatic system controls the above mentioned cable cylinder 35 to move channel 10 downwardly and forwardly toward its position shown in dotted lines and to bring sheet 12 clamped therein into overlying relation to the stack of sheets being accumulated on the horizontal support therebelow.

This condition prevails until bracket 25 of the cable cylinder strikes the limit switch $S_1$ positioned at a predetermined point on arm 28. This switch controls the pneumatic system to release the engagement of the clamping pads 15*b* from the sheet to bring them into the position shown in FIG. 2.

The receiver continues its downward and forward movement with the front portion of sheet 12 resting on the bottom wall 10*b* until the sheet is free to fall downwardly when the front edge of the sheet clears the edge 10*e* of the channel. At this point the bracket 25 of the cable cylinder strikes the second limit switch $S_2$ which controls entry of compressed air to the opposite face of piston P carrying the cable upwardly and rearwardly to its initial position for repetition of the cycle of operation.

In this position the radiant energy system is also placed in the position shown in full lines in FIG. 1, in readiness for projection of clamping pads 15*b* when the radiant energy path again is interrupted by entry of a sheet into the receiver.

As stated above, the sheet unit, after leaving the conveyor C, is clamped in the receiver by two clamps actuated by the photoelectric cell. Thereupon, air is introduced into one end of the cable cylinder, moving the piston therein which drives cable 30 and with it receiver 10 downwardly and forwardly the programmed distance, at which point the sheet unit carried by the carrier is released to fall through a cushion of air onto the stack therebelow, or the stacking position. The carrier in fact travels a slight distance beyond the release point in order to clear the falling sheet.

At the aforesaid movement, the air circuitry is reversed, forcing air into the cylinder on the opposite side of piston P. reversing movement thereof and retracting the carrier to its initial position, to repeat the cycle.

CONCLUSION

It will be seen that we have provided a simple, convenient, fully automatic sheet stacker which, once adjusted for a particular job, will continue without further attention to operate automatically to receive sheared sheet units and move them smoothly downwardly and forwardly, dropping them one at a time onto a stack, or into stacking position, with assurance against scratching or other surface marring.

Various changes coming within the spirit of our invention may suggest themselves to those skilled in the art. Hence, we do not wish to be limited to the particular form shown or uses mentioned, except to the extend indicated in the appended claims.

We claim:

1. An apparatus for stacking thin lightweight sheets having a smoothly finished surface, in an orderly pile, with minimum handling, beyond the outlet end of a conveyor wherefrom the sheets issue by traveling in a forward and downward direction, comprising (a) a movable channel-shaped sheet receiver for intercepting an individual sheet in its travel beyond the outlet end of the conveyor and guiding it in its continued movement in a forward and downward direction into position overlying the pile wherefrom it may fall freely onto the preceding sheet through an air-cushioned space, (b) said receiver comprising a web portion at its front end forming an abutment wall with upper and lower walls extending rearwardly therefrom and forming an open end for receiving the advancing edge of the thin sheet issuing from the conveyor, (c) a reciprocable padded retainer on said receiver incapable of marring or scratching the surface of the sheet adapted to hold the forward edge of the sheet within said receiver in the course of its forward and downward travel, (d) photoelectric means on said receiver generating a beam of radiant energy between said upper and lower walls subject to interception by a sheet entering said receiver through said open end thereof, (e) means for moving said retainer into contact with said sheet, means including a downwardly inclined supporting bar for said movable receiver for guiding said receiver in said forward and downward direction, and means for actuating said receiver in said forward and downward direction in response to the interception of said beam, (f) means releasing said retainer from contact with said sheet at the end of a predetermined extent of travel of the receiver above the front edge of the pile, (g) means for continuing slightly the travel of the receiver beyond said front edge of the pile to permit the front edge of the individual sheet to drop from the open end of the receiver when it is clear of the support afforded by the lower wall thereof, to fall freely onto the preceding sheet, and (h) said means for actuating said receiver adapted to move it in the reverse direction to place it in position to receive the next sheet for stacking onto the pile.

2. Apparatus as in claim 1, wherein said actuating means comprises a cable cylinder having a piston movable in opposite directions by fluid pressure acting on opposite sides of said piston.

3. Apparatus as in claim 1, wherein said actuating means comprises a cable cylinder having a piston movable in opposite directions by fluid pressure acting on opposite sides of said piston, a bracket support for said receiver actuable by said cable cylinder, and limit switches in the path of said bracket support for controlling the releasing movement of said retainer, the following downward and forward movement of said receiver, and the return of the receiver to its initial position.

* * * * *